United States Patent [19]

Shaw et al.

[11] Patent Number: 4,781,855

[45] Date of Patent: Nov. 1, 1988

[54] SODIUM PHOSPHATE COMPOSITION AND PROCESS

[75] Inventors: Brian Shaw, West Bromwich; Raymond A. Smith, Walsall, both of England

[73] Assignee: Albright & Wilson Limited, Oldbury Warley, England

[21] Appl. No.: 143,568

[22] Filed: Jan. 13, 1988

Related U.S. Application Data

[63] Continuation of Ser. No. 041,303, Apr. 22, 1987, abandoned, which is a continuation of Ser. No. 876,808, Jun. 20, 1986, abandoned, which is a continuation of Ser. No. 767,163, Aug. 19, 1985, abandoned.

[51] Int. Cl.[4] ..... C11D 17/06

[52] U.S. Cl. ..... 252/135; 252/156; 252/174; 23/313 FB; 423/315

[58] Field of Search ..... 252/135, 156, 174; 23/313 FB; 423/315, 317

[56] References Cited

U.S. PATENT DOCUMENTS

| | | | |
|---|---|---|---|
| 2,987,483 | 6/1961 | Brooker | 252/156 |
| 3,812,045 | 5/1974 | Gray | 423/315 |
| 4,569,781 | 2/1986 | Fernholz et al. | 252/134 |

*Primary Examiner*—Paul Lieberman
*Assistant Examiner*—Hoa Van Le
*Attorney, Agent, or Firm*—Frishauf, Holtz, Goodman & Woodward

[57] ABSTRACT

A particulate hydrated trisodium phosphate composition useful in heavy duty cleansers has a core and shell structure, the shell being of trisodium phosphate hexahydrate and the core comprising trisodium orthophosphate dodecahydrate and sodium hydroxide. The composition may be made by prilling to form an intermediate body with solid shell and a liquid or solid/liquid core followed by further cooling.

21 Claims, 1 Drawing Sheet

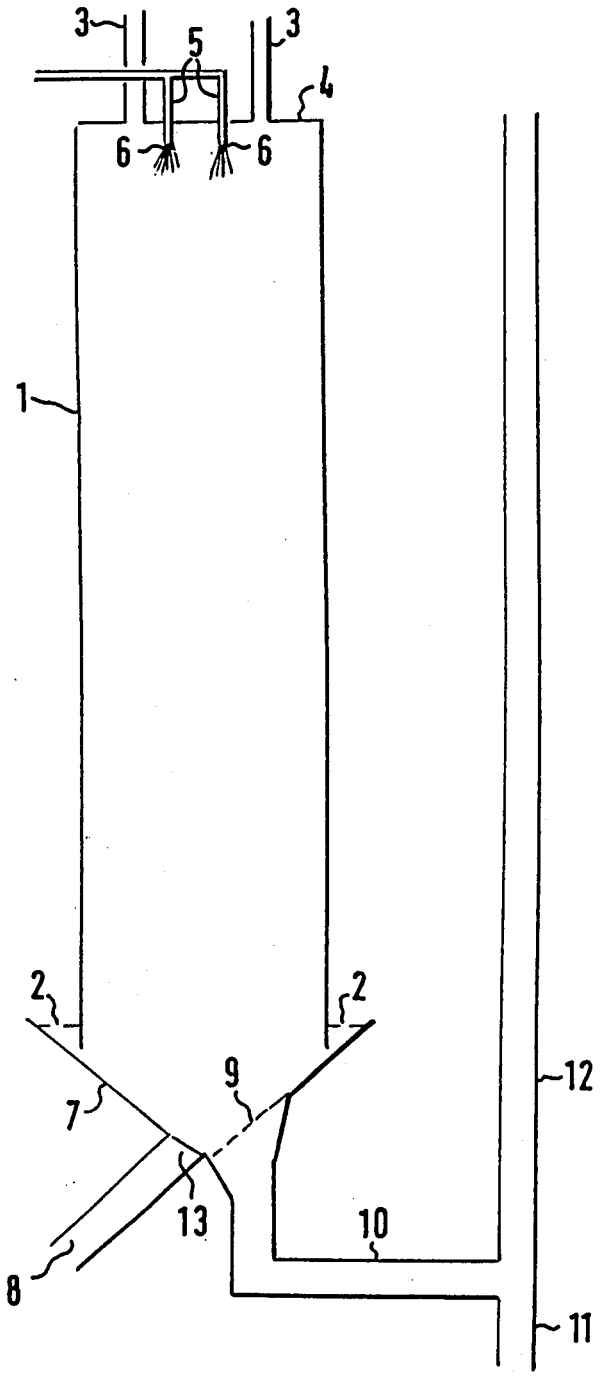
3
5
3
4
6
6
1
2
2
9
7
12
13
10
8
11

SODIUM PHOSPHATE COMPOSITION AND PROCESS

This is a continuation of application Ser. No. 41,303, filed Apr. 22, 1987; which is a continuation of Ser. No. 876,808 filed June 20, 1986 (abandoned); which is a continuation of Ser. No. 767,163 filed Aug. 19, 1985 (abandoned).

This invention relates to phosphate compositions, in particular ones comprising trisodium phosphate, and processes for making them.

Trisodium phosphate crystallizes in anhydrous and many hydrated forms including the hemi-, hexa-, octa- and dodeca- hydrate forms (see J. R. Van Wazer "Phosphorus and its Compounds" Vol.1 page 494). Foremost among these commercially is the dodecahydrate ($Na_3PO_4.12H_2O$) but this compound, as crystallized, usually has an analysis showing the presence of an excess of sodium hydroxide with an Na:P atom ratio of 3.14 or 3.25:1. Mixtures of trisodium phosphate with sodium nitrite or nitrate etc., also crystallize to give mixed salt crystals with small extra amounts of the nitrite or nitrate, etc. anion. (see Van Wazer Phosphorus and Its Compounds Vol 1, page 494 and 495). The dodecahydrate is usually obtained by crystallization but there have been proposals and uses many years ago of spray drying and spray cooling to give solid dodecahydrate (see BIOS Report 1557, Manufacture of Technical Phosphates in West Germany, 1946, pages 30–33) and disclosures of flaking and also spraying into a cooling chamber (Phosphoric Acid Phosphates and Phosphatic Fertilizers by W. H. Waggaman published by Reinhold 1952, Second Edition page 236). However these processes were not continued later and the commercial dodecahydrate has for very many years been the crystalline material with the excess of alkali. But this product is well known to cake on storage and not be a free flowing powder, making its handling more difficult.

We have now discovered a trisodium phosphate composition which can have reduced caking properties and improved flow properties compared to the crystalline dodecahydrate.

The present invention provides a particulate solid hydrated phosphate composition comprising trisodium phosphate and sodium hydroxide with the ratio of the number of atoms to sodium to the number of atoms of phosphorus to the number of moles of hydroxyl group (hereinafter called the ratio of Na:P:OH) being 3.1–3.2:1:0.1–0.2, and the overall ratio of the number of phosphorus atoms to the number of water molecules (hereinafter called the $P:H_2O$ ratio) of 1:8–11, the solid composition having an outer layer comprising trisodium phosphate hexahydrate and a core containing trisodium phosphate dodecahydrate and sodium hydroxide, which are believed to be present as a solid solution.

The present invention also provides a process for preparing a particulate solid hydrated phosphate composition, wherein an aqueous solution at 90°–120° C. of trisodium phosphate and sodium hydroxide, wherein the atomic ratio of Na:P:OH is 3.1–3.2:1:0.1–0.2 and a P:H2O ratio of 1:10–14 is formed into droplets and rapidly chilled substantially out of contact with one another by counter current contact with air to produce particles of an intermediate body with a solid outer layer of trisodium phosphate hexahydrate enclosing a core containing aqueous medium comprising trisodium phosphate and sodium hydroxide and the said particles of the intermediate body are cooled further to give a solid phosphate composition of P:H2O ratio of 1:8–11 having an outer layer comprising trisodium phosphate hexahydrate and a core containing trisodium phosphate dodecahydrate and sodium hydroxide. Preferably the particles of the intermediate body are separated from said counter current air before the subsequent cooling, though at the separation stage the core usually contains solid trisodium phosphate and sodium hydroxide as well as said aqueous medium.

In the hydrated solid composition of the invention, the molar ratio of P to hydroxide is preferably 1:0.12–0.18 e.g. about 1:0.15. In the hydrated solid the overall ratio of $P:H_2O$ is 1:8–11, preferably 1:9–11 such as 1:9.5–11 but especially 1:10–11. However the P to water ratio is not constant throughout the solid, because it is 1:6, or slightly above, in the outer layer and 1:12, or slightly below, in the inner core; the thickness of core and outer layer are such as to give the desired overall P to water ratio. The core/outer layer structure may be shown by X-ray crystallographic analysis of samples taken across a diameter of the particles. The solid composition of the invention is substantially completely water soluble at 20° C. While the solid compositions usually consist essentially of the two trisodium phosphates and sodium hydroxide, they may contain small amounts, e.g. up to 1%, especially up to 0.5% (by weight based on the weight of $Na_3PO_4$) of sodium carbonate, either present as an intentional or accidental ingredient in the sodium hydroxide solution used in the production of the aqueous solution being solidified or because of absorption by the droplets of carbon dioxide from the air used in the solidification process.

The solid compositions of the invention are particles obtained by ejecting droplets of the hot aqueous solution from a sprayer into a stream of gas moving countercurrent to the droplets which subsequently continue to move in countercurrent to the air and essentially out of contact with each other until the intermediate body with the solid outer layer or shell of trisodium phosphate hexahydrate and core containing liquid is produced. After separation if desired from the countercurrent air flow, the particles of this intermediate body are allowed to cool further in or out of contact with each other until the body solidifies completely and its temperature is less than 30° C. The gas initially contacting the droplets as they emerge from the sprayer is at a temperature less than that of the droplets, preferably at less than 60° C. e.g. at 30°–50° C. and that finally contacting the partly solidified intermediate body with solid shell and liquid or liquid/solid core is also at less than the temperature of that body, e.g. at 0°–30° C. such as at 10–20° C. Advantageously the droplets during solidification contact gas of progressively reduced temperature e.g. as happens when the droplets fall under gravity in countercurrent to an upward stream of gas e.g. air, the air being cold e.g. 0°–20° C. at the bottom and being warmed progressively by the molten droplets passing through it. This solidification may be performed in a prill tower in which the hot aqueous solution is pumped to the top of the tower and under sufficient pressure to atomize it, the solution is ejected from one or more, e.g. 1–6 or 2–5, nozzles in a spray head in the form of droplets which fall down the tower against an upward flow of air. The nozzles may be of the solid cone or the hollow cone type and are arranged to minimize overlap between the sprays of droplets and to minimize impact of the droplets on the walls of the tower and to maximize spraying of droplets down the tower. The partly solidified body with the solid shell and liquid or liquid/solid core may be collected from the bottom of the tower and subsequently cooled. The ejection of hot solution into the gas usually causes evaporation of some of the water in the solution, thereby increasing the P:water ratio from 1:10–14 to 1:8–11.

In the process there is initial cooling of the droplets to cause surface solidification of the hexahydrate while at the same time there is evaporation of water from the solution to reduce its water to P ratio. The gas initially contacting the hot droplets preferably has a Relative Humidity of 10–90%. If the hot solution already has a water to P content of 9.5–11:1, e.g. 10–11:1, then the gas may be saturated with water vapour, but advantageously hot phosphate solutions of water to P ratio of 12–13:1 are used and the water to P ratio is reduced in the spraying and solidification steps; in order to obtain products of the desired structure it is then essential that water vapour is evaporated from the droplets before the solidification of the outer shell is complete, as happens when the vapour pressure of the water in the gas contacting the hot molten droplets is less than the vapour pressure of water over the droplets at the temperature of the droplets. When the inlet gas has a high relative humidity and a higher temperature, it is capable of effecting less cooling and less increase of the P:water ratio of the particles than with colder inlet gas of lower relative humidity. The flow of droplets and the $P:H_2O$ content of the input liquid may be adjusted during continuous operation to compensate for variations, if any, in temperature and humidity of the air and to produce a solid product, with the higher the air inlet temperature at constant air flow rate the lower the liquid flow rate, and the higher the humidity the higher the $P:H_2O$ ratio of the input liquid. In addition the higher the flow rate of the air, the higher can be the flow rate of the liquid being solidified; there may be used ratios of the volume of liquid per hour to the volume per hour of gas, e.g. air of not more than 1:10, e.g. not more than 1:15 or 1:20 such as 1:10–50 or 1:15–30.

The intermediate body has a solid shell of hexahydrate and a core which contains a liquid phase of trisodium phosphate dodecahydrate, and sodium hydroxide. The core usually also contains solid dodecahydrate, sodium hydroxide and/or sodium phosphate hexahydrate so the core may have partly, e.g. 50–90%, solidified but not completely solidified. The intermediate body is usually at 30°–70° C., e.g. 40°–70° C. or 30°–50° C., these temperatures being the measured average for the body because it has a relatively cold solid shell and a relatively hot core containing the crystallizing liquid phase and usually solid phase as described above. The intermediate body has sufficient strength that the particles do not coalesce on contact wth one another.

The production of the intermediate body is usually performed in a prill tower of height at least sufficient so that the intermediate body has sufficient strength not to break when hitting the prill tower bottom. The tower is usually 10–30 M high, e.g. 12–20 M. The warm intermediate product is then cooled further to below 35° C., e.g. to below 30° C. The cooling may occur in the tower but preferably is outside the tower. Thus the intermediate body may be cooled at the bottom of the tower by passing air countercurrent through it. This cooling could occur while the particles of intermediate body fall under gravity out of contact with one another in a tower, e.g. with the droplets of hot liquid being sprayed down a tower 50–70 M long against a countercurrent stream of air to produce at the bottom a completely solid composition of the invention at below 30° C. Alternatively a shorter tower could be used so long as the droplets fall out of contact with one another until the intermediate body is produced and then the particles of intermediate body, a significant proportion of which are in contact with one another, e.g. in the form of spheroids with semi molten centres, are cooled by passing air countercurrent through them, before they leave the tower at the bottom at below 30° C. Complete cooling in the tower inevitably raises the temperature of the air contacting the droplets at the top of the tower. Therefore it is preferred to cool the intermediate body outside the tower. The intermediate body is advantageously separated from the countercurrent air stream and is subsequently cooled outside the tower. This later cooling can take place with at least a portion of the particles in contact with one another, e.g. when air is passed through a mass of particles of the intermediate body or is passed through or over a moving optionally perforated conveyor or table on which the intermediate body lies. However the intermediate body is preferably significantly further cooled with the particles substantially out of contact with one another. Thus the particles of intermediate body may be passed from the tower, e.g. by conveyor or vibrating table, into a chamber where they are mixed with air, e.g. tumbled with air and then separated in a cyclone. Most preferably the particles of intermediate body are passed from the tower into a second tower or conduit where they are contacted cocurrent with air having a temperature of 0°–30° C. e.g. by being passed into an upwardly moving air stream in which they move cocurrently and are cooled to 15°–30° C., e.g. in an air lift.

If desired, before the second cooling outside the tower, any oversize particles may be removed. The cooled product of the invention is then obtained of substantially uniform particle size with few fine materials, in contrast to the product obtained by spray drying which gives particles with a breadth of sizes including many fines, e.g. at least 50% of less than 0.25 mm and at least 10% and often at least 20% of less than 0.075 mm. The process can therefore give a higher yield of product of substantially uniform size, e.g. greater than 0.18 mm, than spray drying.

The particles of product of the invention, which are usually substantially spherical are preferably of 0.1–2 mm, e.g. 0.25–1.5 mm; at least 95% may be of 0.18 to 1.5 mm. The vast majority, e.g. at least 90% by weight are usually of 0.25–1 mm and a large majority, e.g. at least 80% are of 0.35–0.7 mm, e.g. about 0.5 mm diameter. The particles of product usually contain less than 1% of less than 0.075 mm. The particles of product of the invention are usually obtained from hot droplets of substantially the same size sprayed from nozzles which are 0.7–4.0 mm e.g. 1.6–3.6 or about 2.5 mm in diameter.

The aqueous feed solution to the sprayer may conveniently be made by reacting a concentrated aqueous solution containing orthophosphate values of Na:P atom ratio less than the desired figure with the requisite amount of concentrated sodium hydroxide solution to give the solution of desired Na:P:OH ratio. The neutralization of the sodium phosphate solution is exothermic and the hot solution may advantageously be used as such for the solidification process of the invention, though extra heat may be provided if required in order to keep the solution of that concentration liquid before the solidification. Examples of solutions of orthophosphate values are those with Na:P ratio of 0–2.2:1, e.g. phosphoric acid or monosodium phosphate or mixures thereof, or disodium phosphate or mixtures therefore with mono- or tri- sodium phosphate.

The solid phosphate compositions of the invention have a reduced tendendy to cake, and they flow more freely than the crystalline products. They may be used in solid cleanser compositions e.g. household cleansers.

Such cleaning compositions may comprise by weight 1–40%, e.g. 10–35% of the solid composition of the invention, 40–99%, e.g. 50–90% of other alkaline compounds such as sodium carbonate or sesquicarbonate sodium tripolyphosphate, or sodium silicate and optionally 0.1–20% of filler, e.g. sodium sulphate, and/or 0.1–2% surfactants, e.g. alkyl-benzene sulphonate such as dodecylbenzene sulphonate and/or 5–15% of a bleaching agent, e.g. a trichloro isocyanurate. Abrasives may be present or absent. These cleaning compositions may be made by dry blending the various ingredients, e.g. by tumble blending.

The compositions of the invention may also be used in industrial applications, e.g. for the phosphating of steel or for the treatment of boiler water.

In a modification of the composition and process of the invention at least a portion of the sodium hydroxide content of the solid composition and hence solution to be solidified is replaced by a sodium salt of a monobasic inorganic acid, e.g. chloride, nitrite, nitrate or hypochlorite.

Thus the present invention also provides a particulate solid hydrated phosphate composition comprising trisodium phosphate and a sodium compound of formula NaX, wherein X is selected from hydroxyl and a monovalent inorganic anion Z and mixtures thereof with the atomic ratio Na:P:X being 3.1–3.2:1:0.1–0.2, and the atomic ratio P:Z:OH being 1: up to 0.2: up to 0.2, e.g. 1:0.01–0.2:0–0.19 and the overall P:$H_2O$ ratio of 1:8–11, the solid composition having an outer layer comprising trisodium phosphate hexahydrate and a core containing trisodium phosphate dodecahydrate and the sodium compound which is believed to be present as a solid solution.

The present invention also provides a process for preparing a particulate solid hydrated phosphate composition wherein an aqueous solution at 90°–120° C. of trisodium phosphate and a sodium compound of formula NaX, where X is selected from hydroxyl and a monovalent inorganic anion Z and mixtures thereof with the atomic ratio of Na:P:X being 3.1–3.2:1:0.1–0.2 and the atomic ratio of P:Z:OH being 1: up to 0.2: up to 0.2, e.g. 1:0.01–0.2:0–0.19, and the overall P:$H_2O$ ratio of 1:9–11 is formed with droplets and droplets rapidly chilled substantially out of contact with one another by countercurrent contact with air to produce particles of an intermediate body with a solid outer layer of trisodium phosphate hexahydrate enclosing a core of aqueous medium comprising trisodium phosphate and sodium compound and then said particles of intermediate body are cooled further to give a solid phosphate composition of P:$H_2O$ ratio of 1:8–11 having an outer layer comprising trisodium phosphate hexahydrate and a core containing trisodium phosphate dodecahydrate and sodium compound. Apart from the change in the chemical composition of the modified solids and the solution used to make them, the modified solids and the process for making them are essentially the same as the solids of the invention without the added NaZ compound, and the process for making them.

The inorganic anion Z is monovalent from a monobasic inorganic acid of formula HZ. The group Z may be a halide, e.g. fluoride or chloride, nitrite, nitrate., permanganate, hypohalite, e.g. hypochlorite or borate. Preferably the group Z is a nitrite or chloride. The group Z may constitute the only group of formula X, but there may also be present hydroxyl group, the proportion of phosphorus to Z to hydroxyl being 1:0.01–0.2:0–0.19 especially 1:0.1–0.15:0–0.04, with the ratio of P to X being preferably 1:0.1–0.18 especially 1:0.12–0.18, e.g. about 1:0.15. The modified solids of the invention may also contain the small amounts of sodium carbonate as described for the solids free of the NaZ compound.

The aqueous solution which is converted to the modified solids of the invention may conveniently be made by reacting a concentrated aqueous solution containing orthophosphate values as described above with an Na:P ratio less than the desired figure with the requisite amount of concentrated sodium hydroxide solution in the presence of the sodium compound NaZ to give the solution of desired Na:P:Z and X:Z ratio. If the desired product is to contain no excess of alkali, i.e. X is constituted by Z only, then enough alkali is added just to titrate the last acidity of the disodium hydrogen phosphate, i.e. to Na:P ratio 3:1. Examples of the solution containing orthophosphate values are as described above.

The modified solid phosphate compositions have a reduced tendency to cake, and hence flow more freely than the corresponding crystalline products. Their degree of free alkalinity per unit volume of powder is also reduced over the phosphate compositions without the NaZ component, a benefit in those solid cleanser compositions, e.g. particular household cleansers where an excess of alkali is undesired. Furthermore the compositions comprising nitrite may advantageously be used in water treatment to combine alkalinity and nitrite content, while those with hypochlorite may be used in solid bleaching compositions.

The process may be performed in apparatus as illustrated in the accompanying figure which is a schematic representation of a prilling tower with associated pipework.

Tower 1 has inlets 2, for air at its bottom and exits, 3, for warm air in its top, 4. Also fitted in its top, 4, are two inlet pipes, 5, with four fixed spray nozzles, 6, through which hot liquid may be ejected. The tower has an inverted conical bottom, 7, the inside surfaces of which, together with the end of the vertical sides of the tower, define the air inlets, 2. On one side of the conical bottom is an exit, 8, for any large lumps with a movable door, 13, and on the other side of the conical bottom, 7, is a grating, 9, e.g. of 30 mm spacing for removal of particles of product. The particles pass through grating, 9, down line 10 which may contain conveying means, e.g. a vibrating table or screen, and are then separated by gravity into any residual large bodies which fall down line 11 and desired particles which move up line 12 carried by a cocurrent stream of air, which enters line 11 and passes up line 12. A suction fan and cyclone (not shown) may be attached to the upper end of line 12 finally to separate the particles of product from the air.

In use the hot aqueous solution of sodium phosphate and sodium hydroxide, optionally with e.g. sodium nitrite, is sprayed down the tower 1 in countercurrent to cooler air passing up the tower from inlet 2 to exits 3. The liquid is partly solidified to give intermediate product with solid shell and partly solidified core and the intermediate product is separated at the bottom of the tower by the grating, 9, into large lumps which are retained and the rest of the product which passes through the grating and is cooled and separated further as described above to give completely solidifed particulate product.

The lumps, which are agglomerations of particles and/or material from the tower walls, fall off the grating, 9, and periodically are removed down exit line 8 by opening the door 13. The air leaving exits 3 may contain ultra fine dust particles of the solid, whose phosphate values may be recovered by scrubbing (not shown).

The process is illustrated in the following Examples, in Example 1-6 of which the solidification apparatus was substantially as described in and with reference to the accompanying Figure and was used in a manner generally as described above.

EXAMPLE 1

488 parts of an 85% w/w aqueous phosphoric acid solution and 1135 parts of a 47% w/w aqueous sodium hydroxide solution were added simultaneously with stirring to 248 parts of water. The resultant liquid of Na:P atom ratio 3.15:1 became hot (about 100° C.) and was heated to 110° C. and its density adjusted by addition of water to 1.53 kg/m$^3$ at 110° C., corresponding to a P to $H_2O$ atom ratio of 1:12.8. The hot liquor was then solidified in the solidification apparatus. The hot liquor was conveyed to the top of a tower, 1, which was 4.5 M diameter and 13.7 M high (as shown in the accompanying Figure) down which it was sprayed from four fixed atomization hollow cone spray nozzles, 6, of 2.5 mm orifice against a countercurrent stream of air with a ratio of the volume of aqueous liquor per hour to volume of air per hour of about 1:16.7. The temperature of the air when the liquid from the nozzle first contacted it was 35° C., while the air entering the tower had a temperature of 18° C. and a relative humidity in the range 40-90%. The process gave a semi-solid product which substantially separated from the counter current air flow which passed up the tower. The semi-solid product was sieved by grating, 9, of 30 mm spacing to remove oversize pieces and the particles of semi-solid product passing through the grating were passed along line 10 by means of a vibrating table contained therein. The particles, the intermediate body, had a solid outer shell and a core of partly solidified aqueous medium; the temperature of the particles was measured as 33° C. The particles passed from the vibrating table into line 12, wherein they were cooled further to 26° C. in cocurrent with an upward stream of air at 18° C. passing through line 11 through line 12. A very small percentage of larger product such as flakes fell down line 11. The particles leaving line 12 at 26° C. were completely solid and were collected via a cyclone. The completely solid particles had an analysis of 45.6% $Na_3PO_4$ 1.8% NaOH, 52.6% $H_2O$, P:$H_2O$ of 1:10.5 and Na:P of 3.15:1. The completely solid product was in the form of substantially spherical particles with a solid shell of $Na_3PO_4$ $6H_2O$ and a solid core comprising $Na_3PO_4$ 0.25NaOH 12H20. The completely solid product particles had the following particle size distribution: greater than 0.7 mm 1.2%, 0.36-0.7 mm 58.9%, 0.25-0.36 mm 32.6%, 0.18-0.25 mm 6.8% and 0.075-0.18 mm 0.6%.

EXAMPLE 2

In another experiment the solid particles were made as described in Example 1.

The ease of flowing of the solid particles was found by determining their angle of repose which was 20°, compared to an angle of 32° for crystalline $Na_3PO_4$ 0.25NaOH $12H_2O$. The solid particles also were much less prone to caking compared to the crystalline $Na_3PO_4$. 0.25NaOH $12H_2O$.

EXAMPLES 3-6

In the same manner as described in Example 1 were made solid particles having the following analyses on a weight basis:

| Example | % $Na_3PO_4$ | NaOH | $Na_2CO_3$ | P:$H_2O$ | Na:P |
|---|---|---|---|---|---|
| 3 | 46.5 | 1.7 | 0.1 | 1:10.3 | 3.157 |
| 4 | 47.5 | 1.7 | 0.2 | 1:9.7 | 3.161 |
| 5 | 44.8 | 1.9 | 0 | 1:10.8 | 3.174 |
| 6 | 47.4 | 1.6 | 0.2 | 1:9.8 | 3.152 |

In the process of Example 3 the input air had a temperature of 20.5° C. and a Relative Humidity of 59%.

The particle size of the product of Example 3 leaving line 12 was as follows—greater than 0.7 mm, 19.3%, 0.36-0.7 mm 56.8%, 0.25-0.36 mm 18.0%, 0.18-0.25 mm 5.1%, 0.075-0.18 mm 0.6%.

The particle size of the product of Example 6 after leaving line 12 and sieving to remove particles larger than 0.75 mm was as follows—greater than 0.7 mm 1.4%, 0.36-0.7 mm 69.4%, 0.25-0.36 mm 22.6% 0.18-0.25 mm 5.0%, 0.075-0.18 mm 1.6%.

EXAMPLE 7

Commercial trisodium phosphate dodecahydrate crystals were dissolved hot in the minimum amount of water to give an aqueous solution of specific gravity 1.535 at 100° C. The aqueous solution was pumped at 100° C. through a preheated hollow cone atomizing nozzle of 1 mm orifice diameter situated at the top of a 13.7M tower, up which air flowed. The air entered the tower at its bottom at ambient temperature. The nozzle produced a spray of droplets which moved downwards countercurent to the upward air and solidified to give warm solid particles with a partly molten core which separated from the upward air, were collected from the bottom of the tower and allowed to cool to below 25° C. Oversized material was removed from a sample of the particles by sieving through a 1.2 mm sieve and a sample of the substantially spherical particles passing through this sieve were analyzed as containing 46.7% $Na_3PO_4$ 3.195:1 Na:P and P:$H_2O$ of 1:10.33. These particles were shown by X-ray crystallography to have a solid shell of $Na_3PO_4.6H_2O$ and a solid core comprising $Na_3PO_4$.0.25NaOH $12H_2O$. X-ray crystallography on a surface layer of the solid, i.e. its shell, showed it to contain $Na_3PO_4$ $6H_2O$ and on a crushed sample of the solid showed it to contain both $Na_3PO_4$ $6H_2O$ and $Na_3PO_4$ 0.25NaOH $12H_2O$. d lines for the compounds in order of decreasing intensities were as follows: $Na_3PO_4.6H_2O$; 4.28, 2.80, 2.62, 3.29, 2.88, 2.55, 2.64, 2.70, and for $Na_3PO_4$ 0.25 NaOH $12H_2O$, 4.34, 10.3, 2.61, 5.39, 3.32, 2.70, 2.87 and 2.86.

EXAMPLE 8

678 parts of 46% w/w aqueous sodium hydroxide solution were added to an aqueous solution of 470 parts of monosodium phosphate and 54 parts sodium nitrite in 320 parts water. The density of the hot solution was adjusted to 1.54 kg/m$^3$ at 105° C. The hot solution was converted to a solid product by atomization and solidification in the manner described in Example 1. The product had an analysis of 46.1% $Na_3PO_4$, 3.8% $NaNO_2$-$CO_3$, 0.1% NaOH, 0.1% $Na_2CO_3$, 49.8% $H_2O$, with a P:$H_2O$ ratio of 1:9.8 and contained a shell layer of $Na_3PO_4$ $6H_2O$ surrounding a core of $Na_3PO_4$ 0.25 $NaNO_2$ $12H_2O$ and NaOH/$Na_2CO_3$.

EXAMPLE 9

A surface sanitizing product had the following composition on a weight basis and was made by dry blending the ingredients in the proportions quoted:

| | |
|---|---|
| Solid particles of Example 1 | 30% |
| Sodium carbonate | 40% |
| Pentasodium tripolyphosphate | 20% |
| Trichloroisocyanurate sold under the trade name FICLOR CLEARON | 10% |

EXAMPLE 10

A carpet cleaning formulation had the following composition on a weight basis and was made by dry blending the ingredients in the proportions quoted.

| | |
|---|---|
| Solid particles of Example 1 | 25% |
| Pentasodium tripolyphosphate | 25% |
| Tetrasodium pyrophosphate | 15% |
| Sodium silicate pentahydrate sold under the trade name METSO | 35% |

EXAMPLE 11

A domestic hard surface cleaner had the following composition on a weight basis and was made by dry blending the ingredients in the proportions quoted:

| | |
|---|---|
| Solid particles of Example 8 | 30% |
| Penta sodium tripolyphosphate | 15% |
| Sodium sesquicarbonate | 54% |
| Surfactant dodecylbenzene sulphonate | 1% |

We claim:

1. A particulate solid hydrated phosphate composition comprising trisodium phosphate and sodium hydroxide with the atomic ratio of Na:P:OH being 3.1–3.2:1:0.1–0.2, and the overall P:$H_2O$ ratio of 1:8–11, the solid composition having an outer layer comprising trisodium phosphate hexahydrate and a core containing trisodium phosphate dodecahydrate and sodium hydroxide.

2. A phosphate composition according to claim 1 of particle size 0.25–1 mm.

3. A phosphate composition according to claim 1 or 2, wherein the overall P:$H_2O$ ratio is 1:10–11.

4. A phosphate composition according to claim 1 or 2 wherein the ratio of Na:P:OH is 3.12–3.18:1:0.12–0.18.

5. A phosphate composition according to claim 3 wherein the ratio of Na:P:OH is 3.12–3.18:1:0.12–0.18.

6. A particulate solid hydrated phosphate composition comprising trisodium phosphate and a sodium compound of formula NaX, wherein X is selected from hydroxyl and a monovalent inorganic anion Z, which is derived from a monobasic inorganic acid HZ and mixtures thereof with the atomic ratio of Na:P:X being 3.1–3.2:1:0.1–0.2, and the atomic ratio P:Z:OH being 1: up to 0.2: up to 0.2 and the overall P:$H_2O$ ratio of 1:8–11, the solid composition having an outer layer comprising trisodium phosphate hexahydrate and a core containing trisodium phosphate dodecahydrate and the sodium compound.

7. A phosphate composition according to claim 6 wherein the atomic ratio of P:Z:OH is 1:0.01–0.2:0–0.19.

8. A phosphate composition according to claim 7 wherein the atomic ratio of P:Z:OH is 1:0.1–0.15:0–0.04.

9. A phosphate composition according to claim 6 or 8 of average particle size 0.25–1 mm.

10. A solid cleanser composition comprising a solid particulate sodium phosphate composition according to claim 1 or 6 together with sodium sesquicarbonate.

11. A composition according to claim 10 also comprising an abrasive.

12. A process for preparing a particulate solid hydrated phosphate composition wherein an aqueous solution at 90°–120° C. of trisodium phosphate and sodium hydroxide, wherein the atomic ratio of Na:P:OH is 3.1–3.2:1:0.1–0.2 and a P:$H_2O$ ratio of 1:10–14 is formed into droplets and rapidly chilled substantially out of contact with one another by countercurrent contact with air to produce particles of an intermediate body with a solid outer layer of trisodium phosphate hexahydrate enclosing a core comprising aqueous medium comprising trisodium phosphate and sodium hydroxide and then said particles of the intermediate body are cooled further to give a solid phosphate composition of overall P:$H_2O$ ratio of 1:8–11 having a solid outer layer comprising trisodium phosphate hexahydrate and a solid core containing trisodium phosphate dodecahydrate and sodium hydroxide.

13. A process according to claim 12 wherein particles of the intermediate body with a solid outer layer and a core comprising partly solidified aqueous medium are separated from said counter current air before being cooled further.

14. A process according to claim 12 or 13 wherein droplets of 0.1–2 mm size initially contact the countercurrent air, which has a temperature of les than 60° C., the particles of intermediate body have an average measured temperature of 70°–30° C. and are cooled to give the solid phosphate compositions at less than 30° C.

15. A process according to claim 13 or 14 wherein the particles of intermediate body are cooled further substantially out of contact with one another.

16. A process according to claim 15 wherein the particles of intermediate body are cooled further in an upward cocurrent stream of air.

17. A process according to claim 13 wherein droplets of 0.25–1 mm of said aqueous solution pass down a tower countercurrent to an upwardly moving air stream to give particles of intermediate body having an average temperature of 35°–50° C., said particles are then separated from said air stream and passed into an upwardly moving air stream in which they move cocurrently and are cooled to 15°–30° C. to produce said solid particulate phosphate composition.

18. A process according to claim 12 wherein said aqueous solution is prilled to give said particulate solid composition.

19. A process according to claim 14 wherein the particles of intermediate body aare cooled further substantially out of contact with one another.

20. A process for preparing a particulate solid hydrated phosphate composition wherein an aqueous solution at 90°-120° C. of trisodium phosphate and a sodium compound of formula NaX, where X is selected from hydroxyl and a monovalent inorganic anion Z, which is derived from a monobasic inorganic acid HZ and mixtures thereof with the atomic ratio of Na:P:X being 3.1-3.2:1:0.1-0.2 and the atomic ratio of P:Z:OH being 1: up to 0.2: up to 0.2 and the overall $P:H_2O$ ratio of 1:10-14 is formed into droplets and rapidly chilled substantially out of contact with one another by counter-current contact with air to produce particles of an intermediate body with a solid outer layer of trisodium phosphate hexahydrate enclosing a core comprising aqueous medium comprising trisodium phosphate and sodium compound and then said particles of intermediate body are cooled further to give a solid phosphate composition of $P:H_2O$ ratio of 1:9-11 having an outer layer comprising trisodium phosphate hexahydrate and a core containing trisodium dodecahydrate and sodium hydroxide.

21. A process according to claim 20 wherein said particles of the intermediate body with a solid outer layer and a core comprising partly solidified aqueous medium are separated from said counter current air before being cooled further.

* * * * *